US005183412A

United States Patent [19]

Nagafuji

[11] Patent Number: 5,183,412

[45] Date of Patent: Feb. 2, 1993

[54] CONNECTOR FOR COAXIAL CABLE

[75] Inventor: Toshiaki Nagafuji, Tokyo, Japan

[73] Assignee: NEC Corporation, Tokyo, Japan

[21] Appl. No.: 851,612

[22] Filed: Mar. 16, 1992

[30] Foreign Application Priority Data

Mar. 18, 1991 [JP] Japan ..... 3-52022

[51] Int. Cl.[5] ..... H01R 13/00

[52] U.S. Cl. ..... 439/578; 439/931

[58] Field of Search ..... 439/578–585, 439/931

[56] References Cited

U.S. PATENT DOCUMENTS 2,163,412 6/1939 Schneider ..... 439/931

3,229,241 1/1966 Kao ..... 439/931

3,363,221 1/1968 Stark ..... 439/931

*Primary Examiner*—Joseph H. McGlynn

[57] ABSTRACT

A cylindrical insulator (1) is provided in which inner and outer surfaces are covered with electroconductive plated layers (2, 2*a*). The layers (2, 2*a*) are directly electrically connected to the shielding wire (4) and core wire (3), respectively, of a coaxial cable (6) while a groove (14) for engagement with outer contacts (7, 7*a*) is formed in the outer surface of the insulator (1) and a projection having the same shape as the groove (14) is provided on the inner surface of the insulator (1) to keep its thickness uniform over its entire length. The shielding wires (4) are connected to the outer surface of the insulator by clamping the wires to the outer plated layer of the insulator by means of a clamping ring.

5 Claims, 2 Drawing Sheets

CONNECTOR FOR COAXIAL CABLE

BACKGROUND OF THE INVENTION

1. Field of the Invention

This invention relates to a connector for a coaxial cable and more particularly to the connector suitable for a small diameter coaxial cable.

2. Description of the Related Art

FIGS. 1 and 2 are cross-sectional views illustrating examples of the conventional connectors for a coaxial cable. The connectors of this type have two control and outer contacts as typified by, for example, an SMA (Sub-Miniature type A) connector as shown in FIG. 1. This connector comprises a center conductor 27 to be connected to a center wire 20 of a coaxial cable 21, a socket surrounding the center conductor 27 to hold it along with an inner insulator 25, and a outer conductor 26 for terminating the socket and a shielding wire 23, which is the outer conductor, extending from an outer cover 22 in conjunction with a nut 24.

The outer conductor 26 and nut 24 of the coaxial connector, the socket part being an insulator, and the outer conductor 27, are manufactured by machining process.

In contrast to the above-described coaxial connector, there are coaxial connectors composed of parts produced by pressing instead of machining process in order to reduce the cost of the parts. Such coaxial connectors are disclosed in Japanese Patent Application Laid-Open No. Hei 1-140572. As illustrated in FIG. 2, the coaxial connector comprises a center conductor 29 serving as an inner conductor which is produced by punching by press, a metal cylinder 32, which is produced by press-molding and which serves as a part of an outer conductor, an plastic insulator 33 surrounding the conductor 29, molded from plastic resins, an inside resin part 30 composed of molding resins for fixedly holding a shielding wire, and a shrinkable tube for covering the shielding wire.

Since this coaxial connector can be automatically assembled from parts produced at low cost by pressing or by molding resins, the coaxial connector can be produced at a low price.

The former coaxial connector has the drawback that the most parts are manufactured by machining, as de scribed above, and hence, a large amount of manpower is required, resulting in high cost. On the other hand, although the latter coaxial connector can be produced by automated machines, it has the drawback that it still requires many number of parts and its cost may not be as low as expected. In addition, the center conductor of the center conductor is not symmetrical in shape with respect to the axis of the coaxial cable. The complicated shape of the inner conductor results in difficulty in matching impedance and a reduction in transmission characteristics. Further, although the advantage of a coaxial cable is the concentric arrangement of the center conductor and outer conductor, this advantage is eliminated by the unsymmetrical shape and the characteristic impedance of the coaxial cable cannot be ensured, leading to the occurrence of distortion in the transmission waveform.

SUMMARY OF THE INVENTION

Accordingly, it is an object of the invention to provide a connector for the coaxial cable which can be manufactured at low cost from a reduced number of parts.

Another object of the present invention is to provide a connector of this type wherein impedance can be easily matched and the impedance characteristics of coaxial cable can be maintained.

The objects of the present invention can be attained by providing a connector for the coaxial cable comprising a cylindrical insulator having a through-hole in the axial direction of a coaxial cable and metal-plated layers formed over the inner and outer surfaces of the insulator such that the center wire of the coaxial cable is electrically connected to the inner metal-plated layer and the outer conductor of the coaxial cable is electrically connected to the outer metal-plate layer.

The connector of this invention may include a metal ring surrounding an end portion of the insulator to form a connection between the outer metal-plated layer of the insulator and the outer conductor of the coaxial cable.

The connector of the invention may further have a groove of a specified depth and specified position in the outer surface of the insulator which is adapted for join of the outer conductor with an external contact. An inner projection in the inner surface of the insulator corresponding in shape and location to the outer groove in the outer surface of the insulator serves to make uniform the thickness of the insulator over its entire length for impedance matching.

The connector for the coaxial cable may also have a spring socket having a contracted cross section securely fitted into the end portion of the through hole.

The connector may have an inner contact for the inner conductor inserted into the end portion of the through hole so as to be secured to the inner plated layer of the insulator and plate-spring-shaped outer contacts fixed to the outer plated layer of the insulator.

BRIEF DESCRIPTION OF THE DRAWINGS

The above and other objects, features and advantages of the present invention will become apparent from the following description referring to the accompanying drawings.

DETAILED DESCRIPTION OF THE PREFERRED EMBODIMENTS

Figure 1:
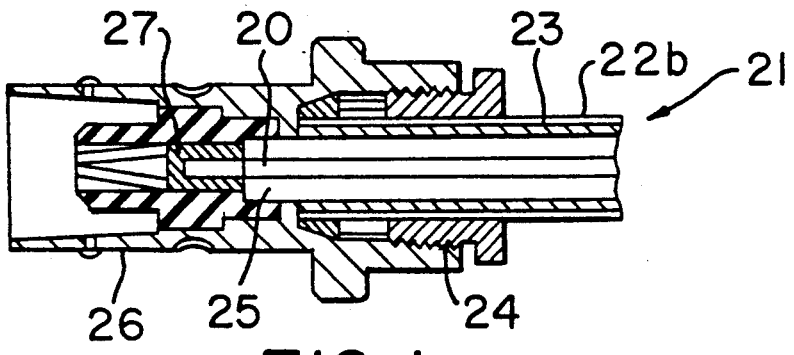
FIG. 1 PRIOR ART
FIG. 1 is a cross-sectional view illustrating an example of a connector for a coaxial cable in the prior art.
Figure 2:
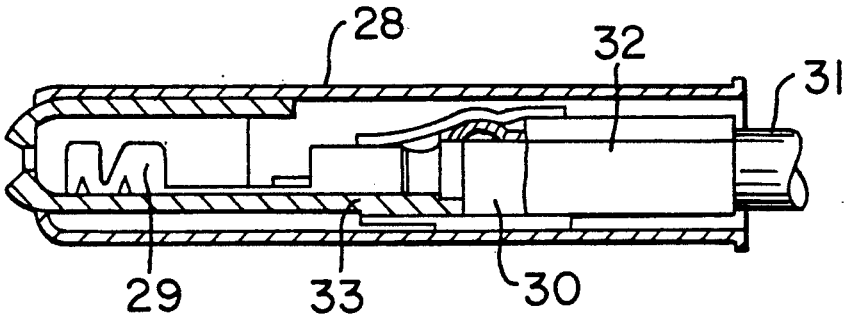
FIG. 2 PRIOR ART
FIG. 2 is a cross-sectional view illustrating another example of a connector for a coaxial cable in the prior art.
Figure 3:
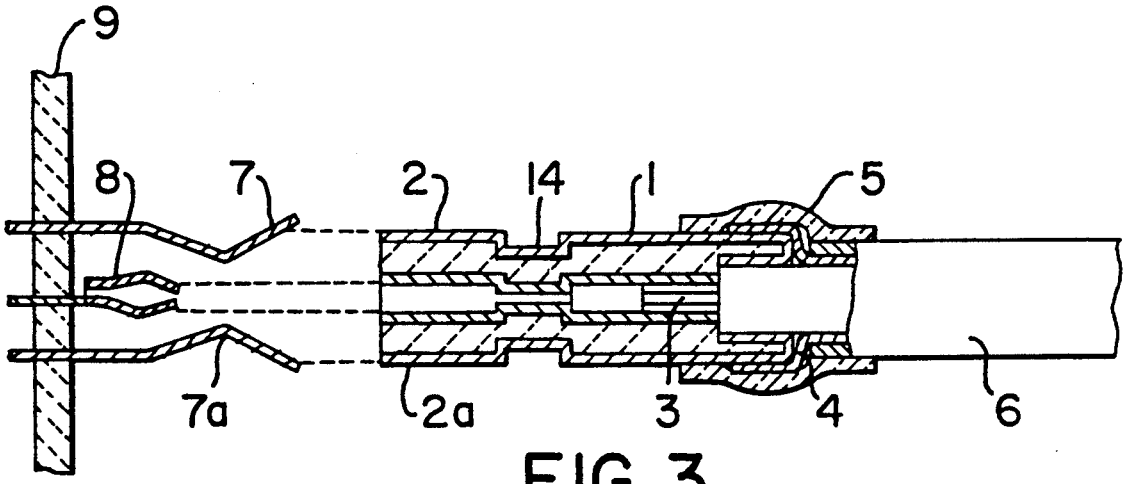
FIG. 3 is a cross-sectional view of an embodiment of a connector for a coaxial cable of the present invention.

FIG. 3 is a cross-sectional view of an embodiment of a connector of the invention. The connector for the coaxial cable includes an insulator 1 with its inner and outer surfaces plated with metal layers 2, **2*a* respectively, which serve as center and outer conductor, respectively. The insulator 1** can be prepared by molding a resin, such as liquid crystal polymer (CCP) or polyphenylene sulphide (PPS) or polyetherimide resin, in the prescribed cylindrical form. Next, the inner and outer surfaces of the cylinder are plated with copper by the electroless copper plating method. Then the insulator is electroplated with nickel and gold to form a comparatively thick layer over the copper plate. In this way, insulators, center conductors and outer conductors can be mass-produced at low cost.

The connector has conductive layers on its outer and inner surfaces. The outer surface is the side round surface of the cylinder including the surface of groove 14 which is a neck and a narrow part. On this outer sur face the plated layer 2 is formed. The shielding wire 4, such as a net or film of a coaxial cable 6 is laid on the one end of the surface of the plated layer 2 and soldered to the plated layer 2, and an insulation member 5, such as a thermal shrinkable tube is fitted over the soldered connection.

The center wire 3 (cable conductor) of the coaxial cable 6 can be coupled by inserting the center wire 3 into the metal layer 2*a* of the insulator 1. A concentric groove 14 may preferably be provided around the part of the outer surface of the insulator 1 so as to mate with external contacts 7, 7*a* formed on a circuit board 9. In this case, a projection having almost the same cross-sectional shape and size as the groove 14 is provided on the inner wall surface of the insulator 1 at a position corresponding to the groove 14 so that the thickness of insulating material of the insulator 1 is kept almost uniform along the entire length of the insulator 1 for impedance matching. The entrance of the inner diameter of the metal layer 2*a* is defined so as to tightly fit over an internal contact 8.

The other entrance of the inner diameter of the metal layer 2*a* is defined by the diameter of the center wire 3 of the coaxial cable 6.

Figure 4:
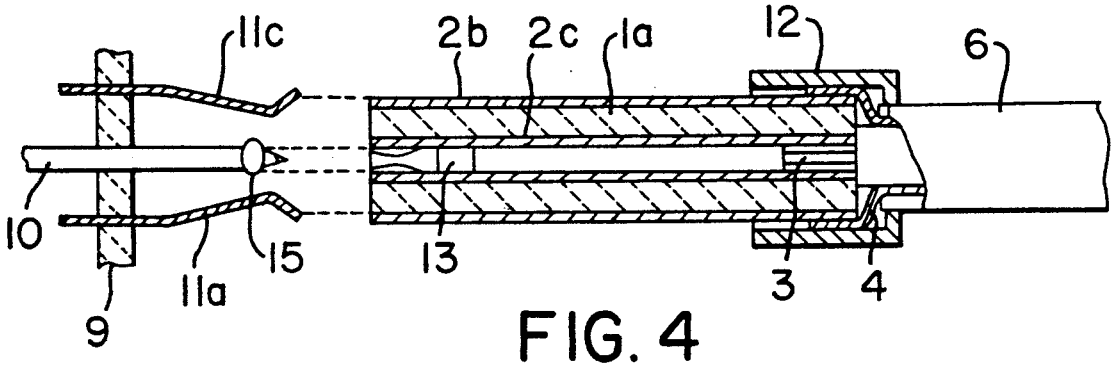
FIG. 4 is a cross-sectional view of another embodiment of a connector for a coaxial cable of the present invention.

FIG. 4 is a cross-sectional view of another embodiment of a connector of the present invention. The connector for the coaxial cable comprises an entirely cylindrical insulator 1*a* having no groove. The shielding wire net 4 contacts with the metal-plated layer 2*b* around the insulator 1*a*. A metal clamping ring 12 is fitted over the contact connection instead of the insulating member 5 formed from a shrinkable tube.

In this manner, the exposed portion of the shielding wire net 4 uniformly surrounds and connected with outer conductive layer 2*b* by the metal ring 12 clamped, and the center wire 3 is connected with inner conductive layer 2*c*. It is easy to connect the coaxial cable and the connector.

Since the insulator 1*a* has no particular idreregularities on its outer surface, when connected, it is simply mated between external contacts 11, 11*a*. To ensure sufficient contacts between the outer surface of the insulator and contacts, a spring socket 13 having contracted inner cross section is fixed on the inner surface of the insulator 1*a* so that when a plug 10 is inserted into the socket 13, a projection 15 of the plug 10 contacts with the contracted section of the socket. A connector having such an engagement structure is perfectly adequate for use.

Figure 5:
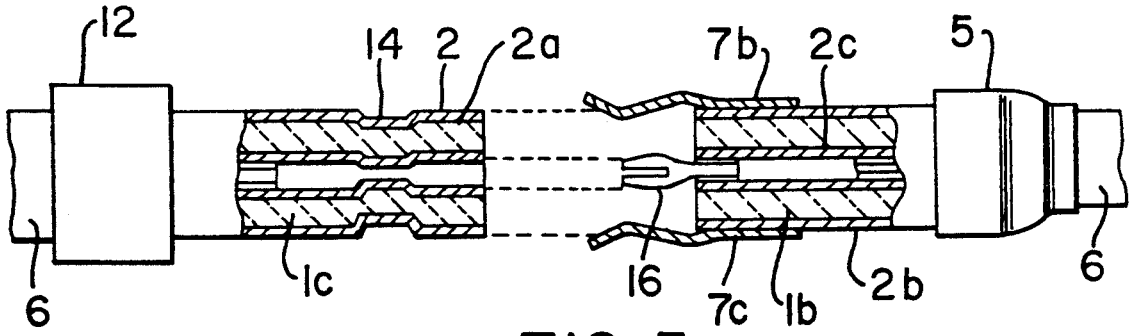
FIG. 5 is a cross-sectional view of a connector for a coaxial cable of the present invention illustrating two type connectors, each having the structure of the connector according to the present invention.

FIG. 5 is cross-sectional view of another embodiment of the connector for the coaxial cable of the present invention. The connectors utilizing the previously described insulators will be described. As shown in FIG. 5, the connector (right side connector) is prepared by fixing plate-spring-shaped external contacts 7*b*, 7*c* to the outer plated layer 2*b* of an insulator 1*b* and inserting one end of an elastic plug 16 into the insulator 1*b* so as to fix it to the inner plated layer 2*c*. The connector (left side connector) comprises an insulator 1*c* which has a groove 14 on the part of its outer periphery. The present invention has the advantage that a coaxial cable connection formed by such two connectors can be realized with ease by employing the insulators according to the invention.

As described above, the connector according to the present invention affords special advantages, including the fact that this connector can be assembled by merely providing the inner and outer surfaces of a cylindrical insulator with electro-conductive layers and electrically connecting said layers to the center and outer conductors of a coaxial cable, with the result that the number of parts making up the connector is reduced and hence the cost of assembling the connector is decreased, and at the same time, impedance matching can be easily effected while maintaining the characteristics of a coaxial cable.

What is claimed is:

1. A connector for a coaxial cable comprising a cylindrical insulator having therein a through-hole in the core direction of a coaxial cable and metal-plated layers formed on the inner and outer surfaces of said insulator, wherein the inner conductor and outer conductor of said coaxial cable are electrically connected to the inner metal-plated layer and outer metal-plated layer of said insulator respectively.

2. The connector of claim 1, wherein a metal ring surrounding an end portion of said insulator is provided whereby said outer metal-plated layer is connected to said outer conductor of the coaxial cable.

3. The connector of claim 1, wherein a groove having a specified depth adapted for engagement with external contacts is formed in the outer surface of said insulator at a specified position thereof and a projection in the inner wall surface of said insulator having the same shape as said groove is formed at a position corresponding to that of said groove to keep uniform the thickness of said insulator along its entire length.

4. The coaxial connector of claim 1, wherein a spring socket having a contracted cross section therein is securely fitted into the end portion of the through hole of said insulator.

5. The connector of claim 1, wherein an inner contact for said inner conductor is inserted into the end portion of said through hole so as to be secured to the inner plated layer thereof and plate-spring-shaped outer contacts are fixed to the outer plated layer of the insulator.

* * * * *